US005901885A

United States Patent [19]

Iida

[11] Patent Number: 5,901,885

[45] Date of Patent: May 11, 1999

[54] CAP FOR SHAKER

[75] Inventor: Motoyori Iida, Amagasaki, Japan

[73] Assignee: Japan I.P. Co., Ltd., Hyogo, Japan

[21] Appl. No.: 08/984,142

[22] Filed: Dec. 3, 1997

[51] Int. Cl.[6] ..... B67D 3/00

[52] U.S. Cl. ..... 222/517; 222/565

[58] Field of Search ..... 222/336, 517, 222/556, 565, 264

[56] References Cited

U.S. PATENT DOCUMENTS

| | | | |
|---|---|---|---|
| 2,028,843 | 1/1936 | Pischke | 222/517 |
| 2,037,172 | 4/1936 | Leffert | 222/556 |
| 4,106,672 | 8/1978 | Tecco et al. | 222/565 |
| 4,305,515 | 12/1981 | Tontarelli | 222/517 |
| 5,735,438 | 4/1998 | Ostrowsky | 222/517 |

*Primary Examiner*—Joseph A. Kaufman
*Attorney, Agent, or Firm*—Wenderoth, Lind & Ponack, L.L.P.

[57] ABSTRACT

A shaker cap having a cover which can be opened easily and is adapted to close automatically. The cap includes a cylindrical cap body having a top wall formed with holes and a threaded portion threaded onto the mouth of a shaker. The holes of the cap body are opened and closed by a cover. The cover is coupled to a control piece through gear engagement so that when the control piece is pressed, the cover pivots open. As soon as the pressure on the control piece is removed, the control piece spontaneously moves back to the original rest position biased by a spring piece. The cover thus pivots shut.

2 Claims, 9 Drawing Sheets

CAP FOR SHAKER

BACKGROUND OF THE INVENTION

This invention relates to a cap to be put on a shaker for e.g. salt or pepper.

A cap of this type includes a cylindrical cap body to be put on the mouth of a shaker container. The cap body has a top wall formed with a plurality of holes through which the content of the shaker is shaken out. The holes are closed by a cover. Caps of this type are disclosed e.g. in unexamined Japanese patent publication 6-54747, examined Japanese utility model publication 4-15663, and unexamined Japanese patent publication 6-227555.

The cap disclosed in the first publication has a cover which has to be pushed up and down by hand to open and close it. The cover has to be pushed up or down with one hand while holding the container with the other hand. This is troublesome.

The cap disclosed in the second publication has a lever. By pressing the lever, the cover opens fairly smoothly. But the cover has to be closed by pushing it down by hand as with the cover of the first publication. Also, this cap is complicated in structure.

The cap disclosed in the third publication is shown in FIG. 10. It has a press button 1 and a cover 5 coupled to the button 1 through a push rod 3 and a changeover rod 4. By pressing the button 1 against the force of a spring 2, the cover 5 pivots from the closed position shown by solid line to the open position shown by chain line. When the button 1 is pressed again, the cover 5 pivots back to the closed position. Thus, the cover 5 can be opened and closed by pressing the single button 1. The trouble of this cap is that the button has to be pressed in different ways to open and close the cover, and thus the container has to be gripped in different ways. Another problem is its extremely complicated structure.

In many cases, cooks, both amateurs and pros, handle a shaker with one hand while holding a pot or a pan with the other hand. Thus, shakers which can be easily handled with one hand are desired.

An object of this invention is to provide a cap for a shaker which is simple in structure and has a cover which can be easily opened and closed.

SUMMARY OF THE INVENTION

According to this invention, there is provided a cap for a shaker including a cylindrical cap body to be fitted on a mouth of a shaker container, the cap body having a top wall formed with a plurality of through holes through which the content of the container B is to be shaken out, and a cover for closing the through holes, characterized in that the cover has one end thereof coupled to the cap body so as to be pivotable up and down, that the cover has a pivot shaft portion having a gear formed on its outer periphery, that the cap body is provided with a control piece pivotable back and forth, the control piece being formed with a gear engageable with the gear of the pivot shaft portion, that the back-and-forth pivoting motion of the control piece is converted through the engagement of the gears into the pivoting motion of the cover between an open position and a closed position, and that a biasing force that tends to move the cover toward said closed position is applied to the cover or the control piece.

The cover is biased toward the closed position by a spring piece integrally formed on the control piece and resiliently pressed against the cap body.

While not in use, the holes of the cap fitted on a shaker container are closed by the cover. To open the holes, the container is gripped and the control piece is pressed. Since the cover is coupled to the control piece through gear engagement, the cover pivots open by pressing the control piece. The holes thus open. Then, as soon as the pressure on the control piece is removed, the cover spontaneously pivots shut under biasing force. The cover can thus be easily opened and closed with a single hand. There is no need to change the way the container is gripped.

Other features and objects of the present invention will become apparent from the following description made with reference to the accompanying drawings, in which:

DETAILED DESCRIPTION OF THE PREFERRED EMBODIMENT

Figure 1:
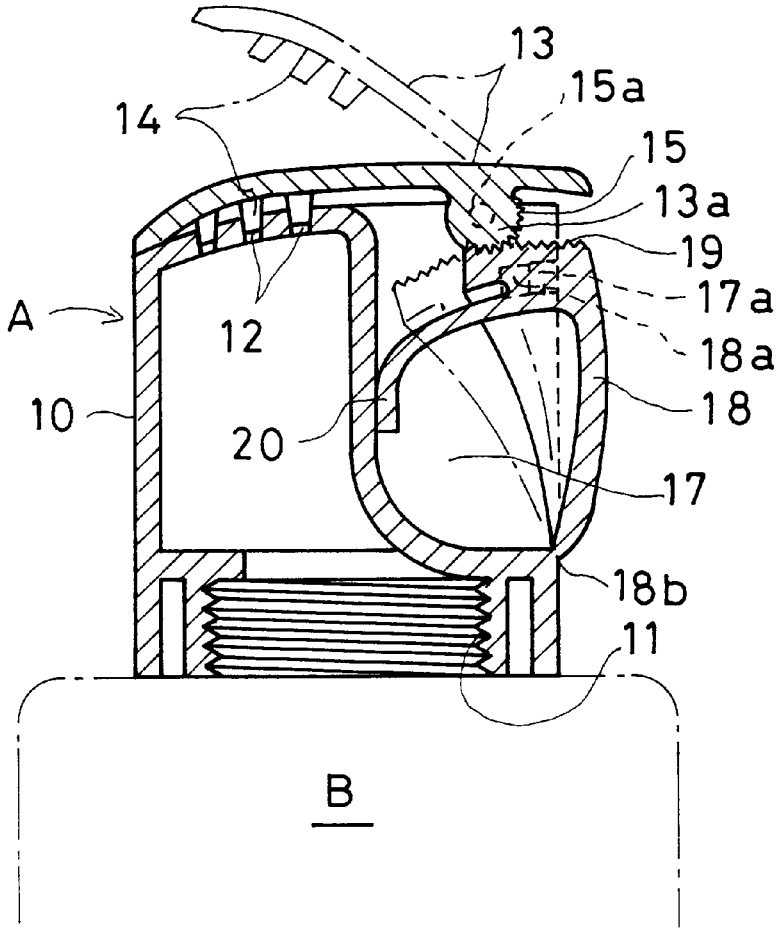
FIG. 1 is a sectional view of one embodiment.
Figure 2:
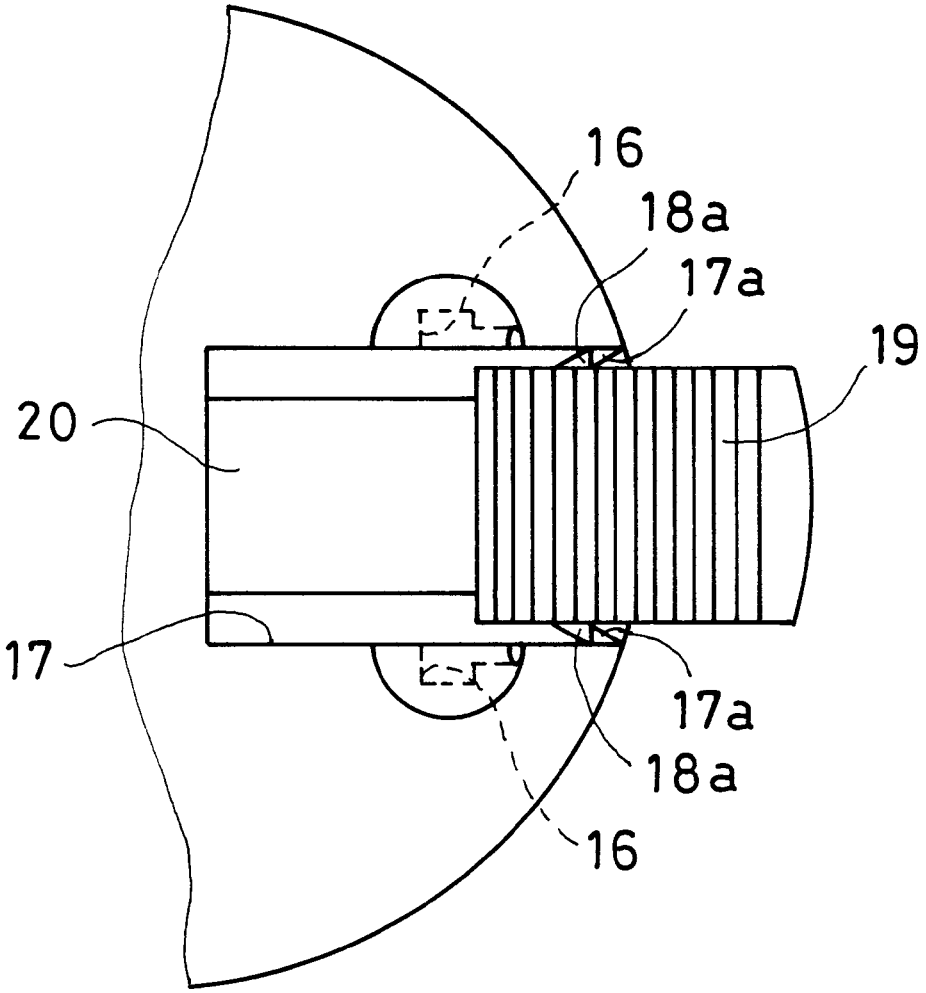
FIG. 2 is a partial plan view of the embodiment of FIG. 1, the cover not shown.
Figure 3:
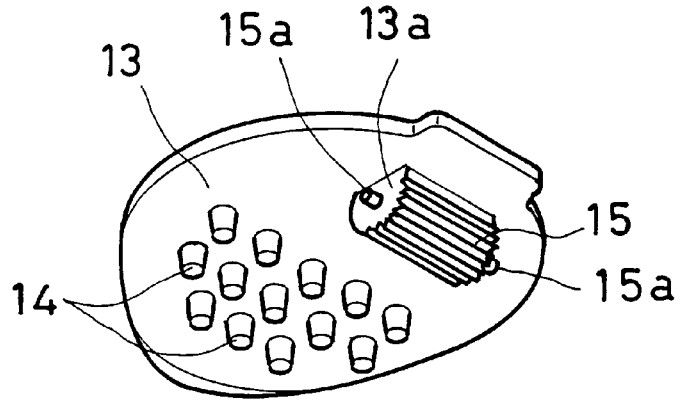
FIG. 3 is an exploded perspective view of the FIG. 1 embodiment.
Figure 3:
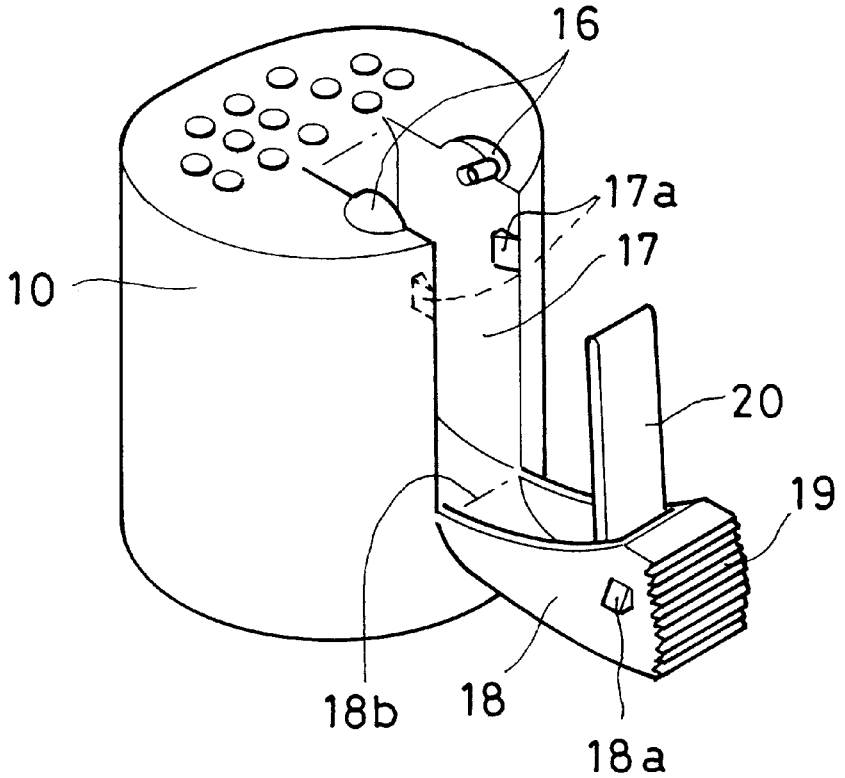

An embodiment is shown in FIGS. 1 to 3. The cap A of this embodiment is fitted on a container B by screwing a threaded portion 11 formed on its cylindrical body 10 onto the mouth of the container B. The cap body 10 has a top wall in which are formed a plurality of through holes 12.

Over the cap body 10 is a cover 13 having its rear end supported on a pin 15*a* for vertical pivoting motion about the pin 15*a*. When the cover 13 is in its closed position shown by solid line in FIG. 1, its protrusions 14 fit in and close the respective holes 12. The cover 13 has a pivot shaft portion 13*a* surrounding the pin 15*a*. A gear 15 is formed on the outer periphery of the portion 13*a*. To mount the cover 13 on the cap body 10, with the pin 15*a* inserted through the shaft portion 13*a*, the ends 15*a* of the shaft 15 are press-fitted in holes 16 in the cap body 10 (FIG. 3).

A recess 17 is formed in the rear of the cap body 10. A control piece 18 has its bottom end connected to the cap body 10 through a hinge portion 18*b*. Formed on top of the control piece 18 is a gear 19 in mesh with the gear 15 of the cover 13. Thus, when the control piece 18 is pushed in from the position shown by solid line to the position of chain line (FIG. 1), the cover 13 pivots from the closed to open position, shown by chain line. The degree of opening of the cover 13 is determined by the length of the gears 15 and 19. Preferably, the gears 15 and 19 are long enough so that the cover 13 can pivot more than 90° from the closed to open position.

Provided at the inner end of the control piece 18 is a spring piece 20 which is resiliently pressed against the wall of the cap body 10 to bias the control piece 18 rearward. To open the cover 13, the control piece 18 is pushed in against the force of the spring piece 20. As soon as the push-in force disappears, the spring piece 20 pushes the control piece 18 back to the original rest position (solid line).

Referring to FIG. 2, the control piece 18 is further provided with projections 18*a* adapted to engage projections 17*a* formed on the wall surface of the recess 17 when the control piece 18 is pushed back by the spring piece 20 to the original rest position, thus preventing the control piece from moving rearwardly beyond the original rest position. The projections 17*a* and 18*a* are preferably triangular in shape, because the triangular projections 18*a* can easily get over the triangular projections 17*a* when the control piece 18 is pushed into the recess 17. The projections 18*a*, 17*a* may be omitted if the cover 13 is so designed as to abut the top of the cap body 10, preventing the control piece 18 from getting back excessively when the control piece is pushed back to the intended rest position.

The cap of the embodiment is a resin-molded product. FIG. 3 shows the initial state of the cap before assembled. Before or after the cap is fitted on the mouth of the container B, the control piece 18 is pushed into the recess 17 by pivoting it about the hinge 18*b* until the projections 18*a* get over the projections 17*a*.

To shake out the content (such as pepper) of the container B fitted with the cap, the control piece 18 is pushed in to pivot open the cover 13. As soon as the push-in force is removed, the cover 13 is pivoted back to the closed position by the spring piece 20. The engagement of the gears 15, 19 permits smooth pivoting motion of the cover 13.

Figure 4:
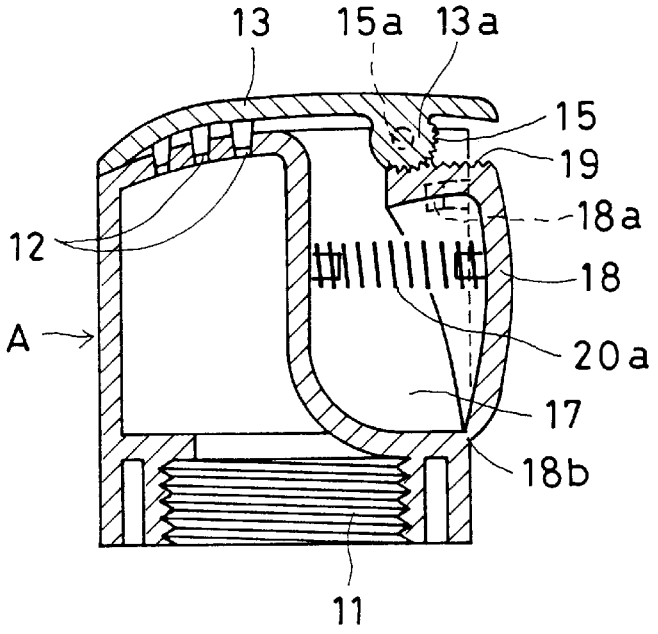
FIG. 4 is a sectional view of another embodiment.
Figure 5:
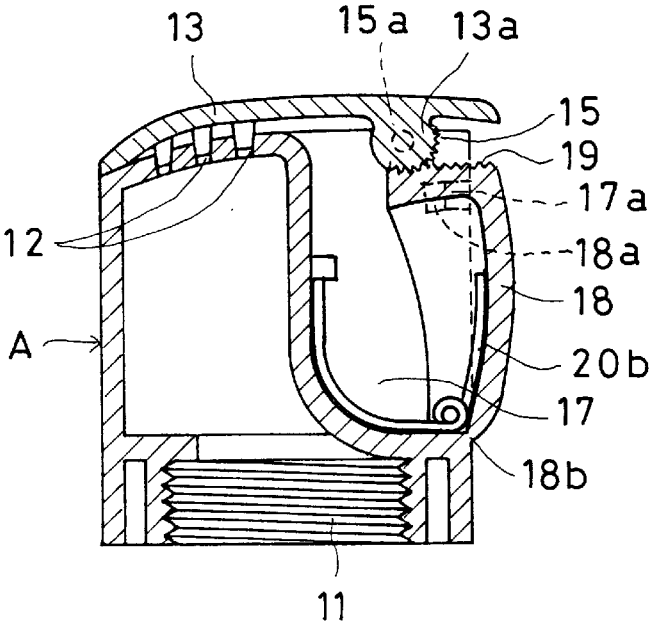
FIG. 5 is a sectional view of another embodiment.

Instead of the spring piece 20, the cover 13 may be biased toward its closed position by a coil spring 20*a* shown in FIG. 4, a torsion spring 20*b* shown in FIG. 5, or an unillustrated torsion spring provided around the pin 15*a*.

Figure 6:
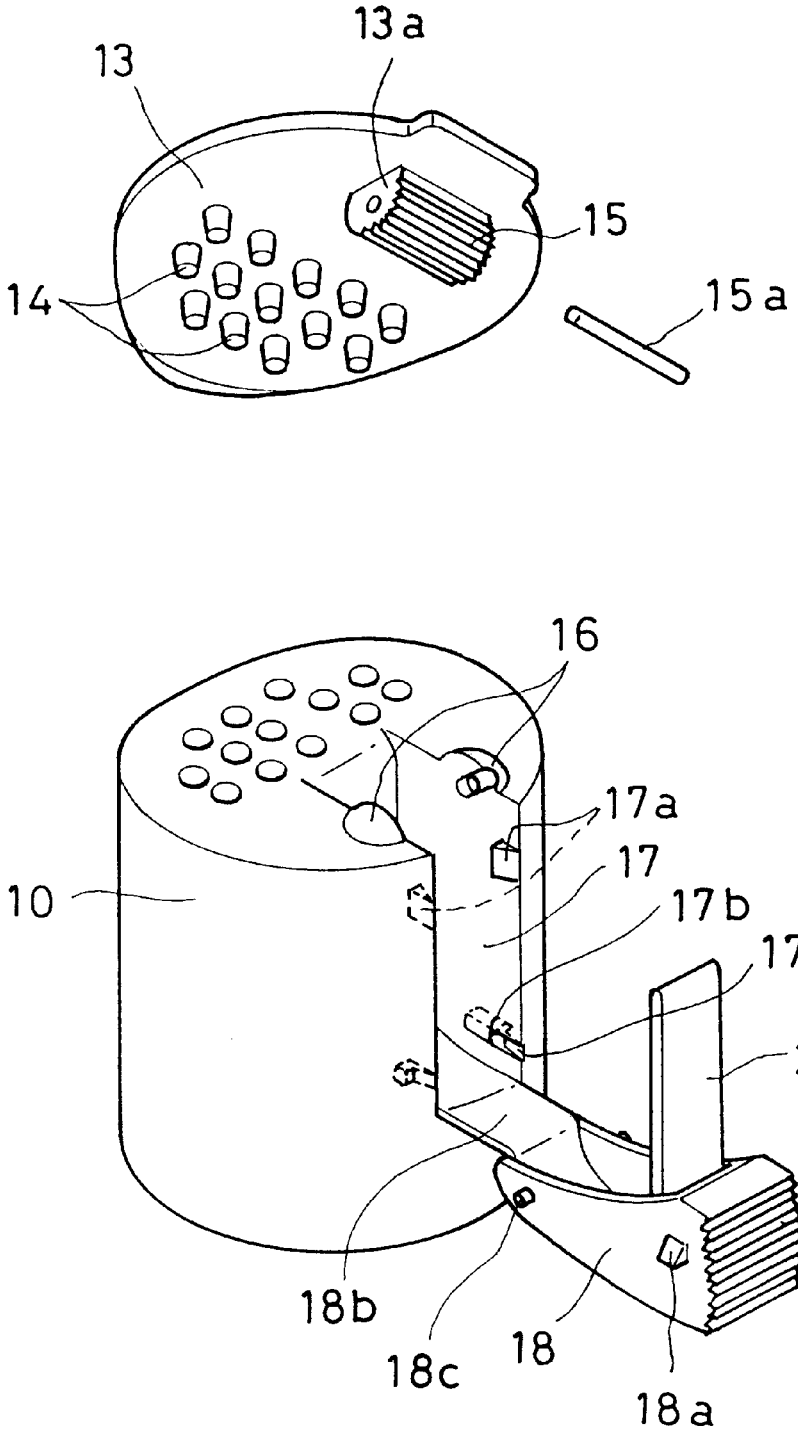
FIG. 6 is an exploded perspective view of another embodiment.

In the embodiment of FIG. 6, the control piece 18 may be connected to the cap body 10 through a longer hinge portion 18*b*, and be pivotable about pins 18*c* provided on both sides thereof and engaged in holes 17*b* formed in both sides of the recess 17. Each hole 17*b* may include a guide groove 17*b*′ or may be in the form of an elongate hole as shown by chain line in FIG. 6 so that the pins 18*c* can move back and forth in the holes 17*b*. The limited freedom of movement of the pins 18*c* corrects any cross engagement of the gears 15 and 19, thus ensuring smooth movement of these gears. The pin 15*a* and the cover 13 may be separate members as shown in FIG. 6.

Figure 7:
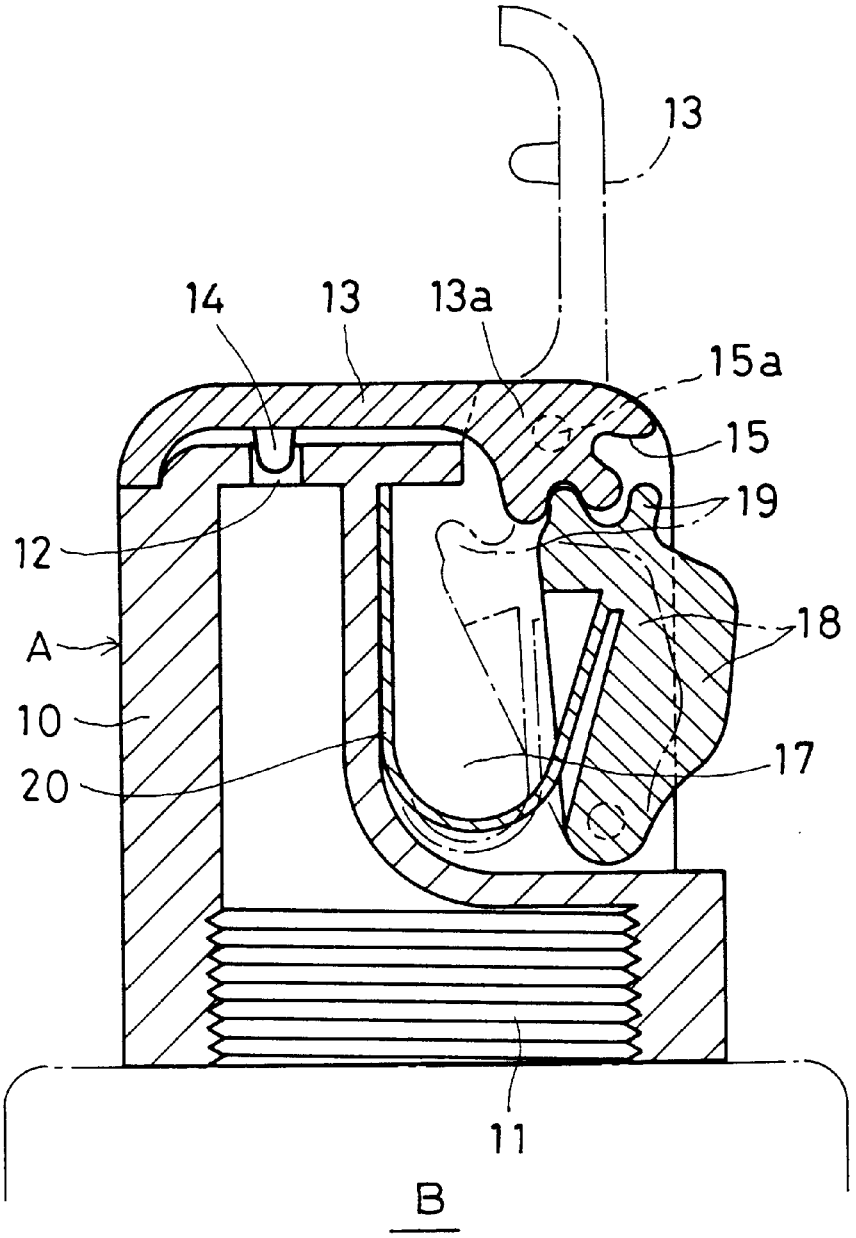
FIG. 7 is a sectional view of another embodiment.
Figure 8:
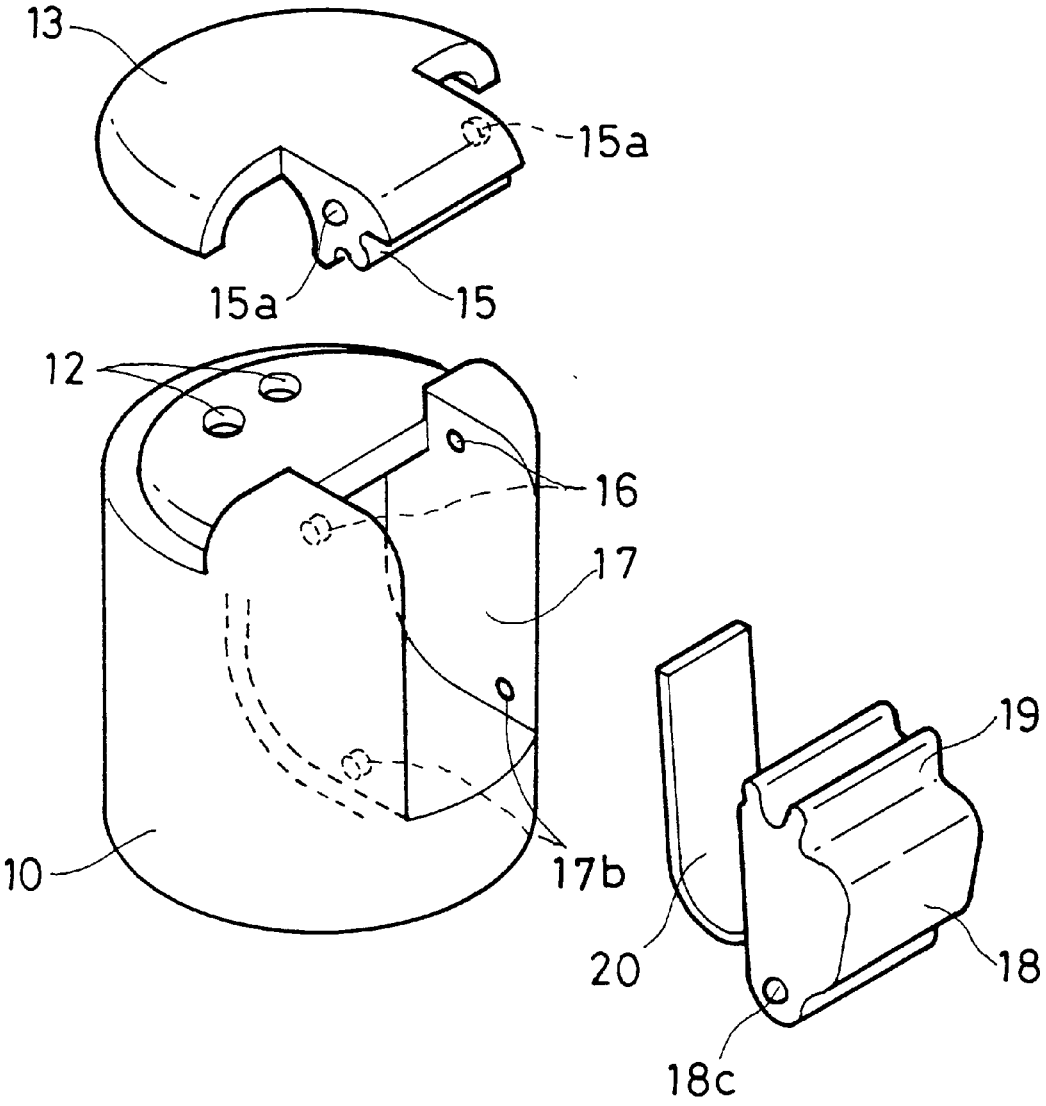
FIG. 8 is an exploded perspective view of the FIG. 7 embodiment.

FIGS. 7 and 8 show a further embodiment, in which the control piece 18 is a separate member having an integral spring 20 bent in the shape of U in the recess 17. The U-shaped spring 20 is larger and thus more moderate in motion than spring of FIG. 1, so that the cover 13 can be pivoted more smoothly between the open and closed positions. In the embodiment of FIGS. 7 and 8, the control piece 18 is mounted to the cap body 10 by engaging its projections 18*c* into holes 17*b* formed in the cap body 10.

Figure 9:
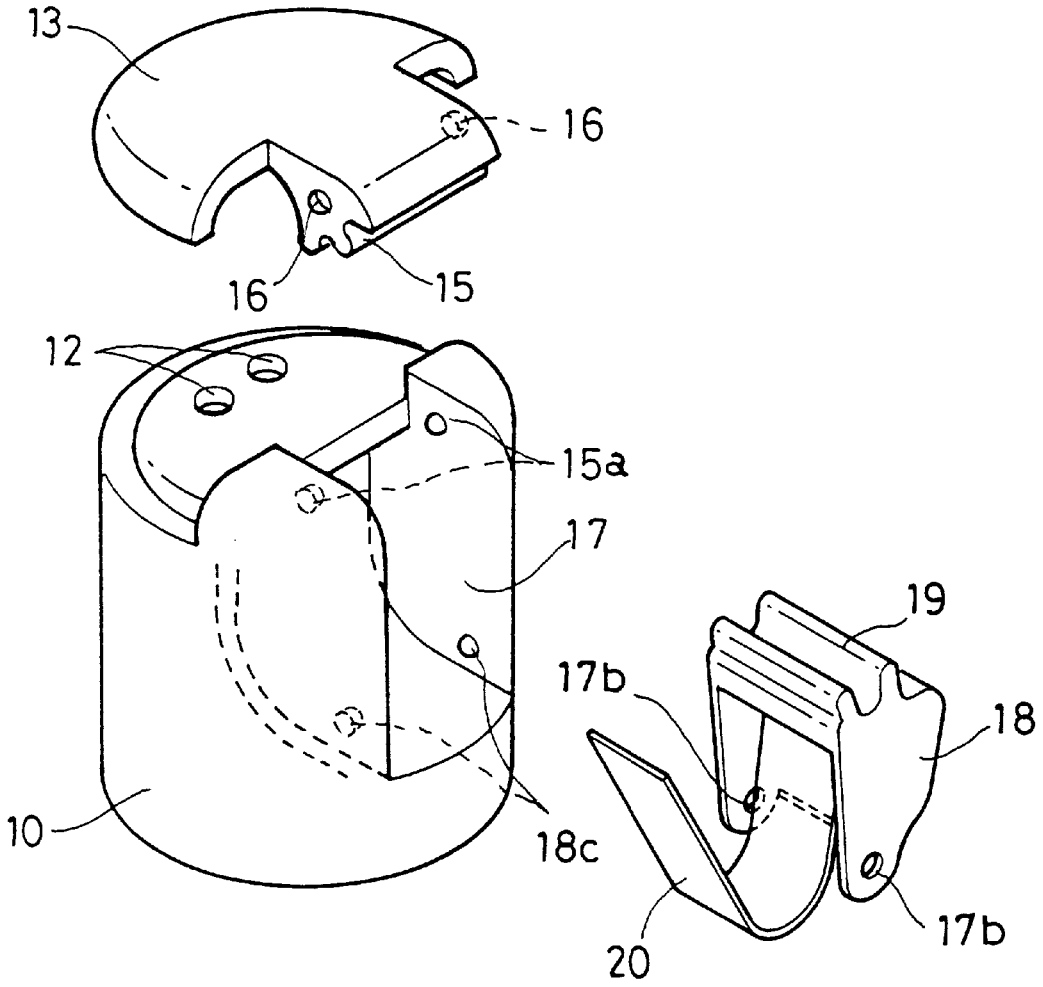
FIG. 9 is a partial exploded perspective view of another embodiment.
Figure 10:
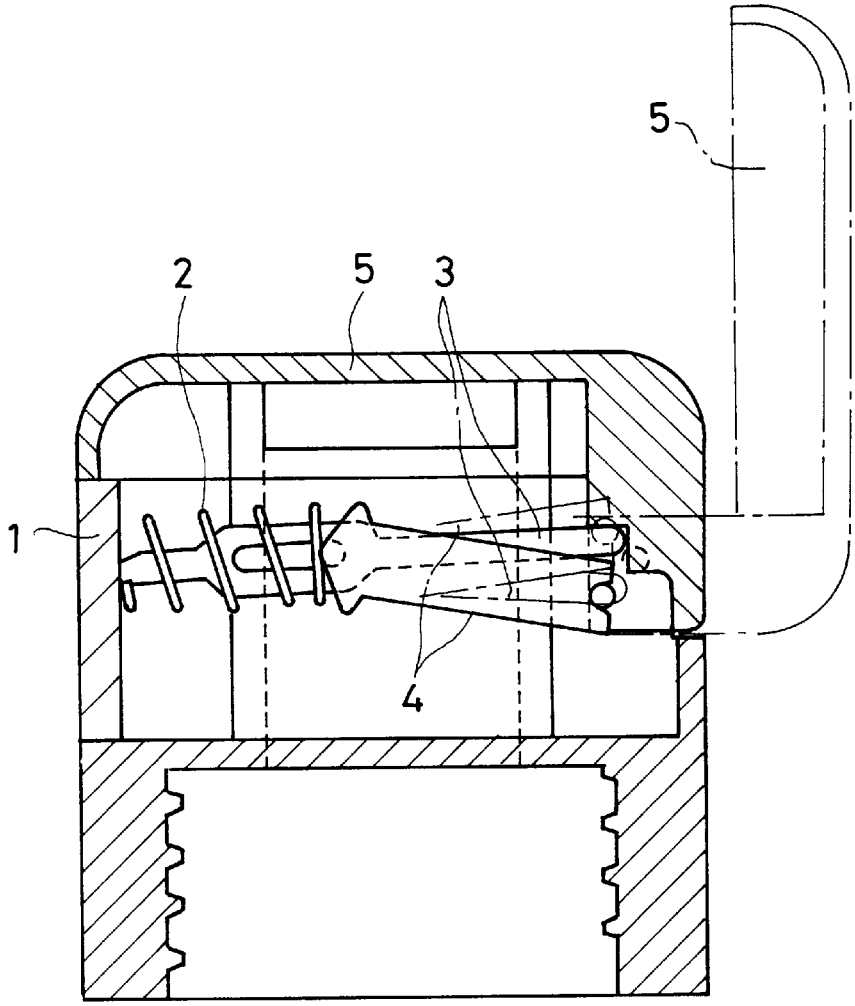
FIG.10 PRIOR ART
FIG. 10 is a sectional view of a conventional shaker cap.

In the embodiment of FIG. 9, the control piece 18 and the cover 13 are mounted to the cap body 10 by engaging projections 18*c* and 15*a* formed on the cap body 10 into holes 17*b* and 16 formed in the control piece 18 and the cover 13, respectively. As shown in FIG. 9, the holes 17*b* are preferably through holes formed in resilient members of the control piece 18, because with this arrangement, the projections 18*c* can smoothly fit in the holes 17*b* by deforming the resilient members.

Each of the gears 15, 19 have several teeth (and grooves). The number of teeth of each gear should be many enough for smooth pivoting motion of the cover 13. The gear sizes are not limited provided the cover 13 can be smoothly opened and closed.

The cap of each embodiment is made up of a very small number of parts, specifically either two parts, i.e. cap body 10 and cover 13, or three parts, i.e. cap body and cover plus separate spring 20*a* or 20*b* or separate control piece 18.

The cover can be opened and closed reliably because the cover is connected to the control piece through gear engagement. To shake out the content of the shaker, the cover is opened by pressing the control piece. Then, as soon as the control piece is to released, the cover spontaneously closes biased by the spring. The user does not have to push the cover or press any button to close the cover. All he or she does is to release the control piece and return the shaker onto a shelf.

What is claimed is:

1. A cap for a shaker including a cylindrical cap body to be fitted on a mouth of a shaker container, said cap body having a top wall formed with a plurality of through holes through which the content of the container is to be shaken out, and a cover for closing said through holes, characterized in that said cover has one end thereof coupled to said cap body so as to be pivotable up and down, that said cover has a pivot shaft portion having a gear formed on its outer periphery, that said cap body is provided with a control piece pivotable back and forth, said control piece being formed with a gear engageable with the gear of said pivot shaft portion, that the back-and-forth pivoting motion of said control piece is converted through the engagement of said gears into the pivoting motion of said cover between an open position and a closed position, and that a biasing force that tends to move said cover toward said closed position is applied to said cover or said control piece.

2. A cap as claimed in claim 1 wherein said cover is biased toward said closed position by a spring piece integrally formed on said control piece and resiliently pressed against said cap body.

* * * * *